US010858909B2

(12) United States Patent
Arabsky et al.

(10) Patent No.: US 10,858,909 B2
(45) Date of Patent: Dec. 8, 2020

(54) PRESSURE ACTIVATED COMPLETION TOOLS, BURST PLUGS, AND METHODS OF USE

(71) Applicant: INTERRA ENERGY SERVICES LTD., Calgary (CA)

(72) Inventors: Serhiy Arabsky, Beaumont (CA); Vitaliy Arabsky, Beaumont (CA)

(73) Assignee: INTERRA ENERGY SERVICES LTD., Calgary (CA)

( * ) Notice: Subject to any disclaimer, the term of this patent is extended or adjusted under 35 U.S.C. 154(b) by 69 days.

(21) Appl. No.: 16/159,288

(22) Filed: Oct. 12, 2018

(65) Prior Publication Data

US 2019/0040716 A1 Feb. 7, 2019

Related U.S. Application Data

(63) Continuation of application No. 15/108,227, filed as application No. PCT/CA2014/000855 on Dec. 1, 2014, now Pat. No. 10,125,574.

(Continued)

(51) Int. Cl.
*E21B 43/26* (2006.01)
*E21B 34/10* (2006.01)

(Continued)

(52) U.S. Cl.
CPC ..... *E21B 34/10* (2013.01); *E21B 34/063* (2013.01); *E21B 43/14* (2013.01); *E21B 43/26* (2013.01); *E21B 2200/05* (2020.05)

(58) Field of Classification Search
CPC ..... E21B 34/063; E21B 43/26; F16K 17/162; F16K 17/1606; F16K 17/16;

(Continued)

(56) References Cited

U.S. PATENT DOCUMENTS 3,908,684 A 9/1975 Short
4,669,626 A * 6/1987 Mozley ..... F16K 17/1606 137/68.26

(Continued)

FOREIGN PATENT DOCUMENTS

CA 2692377 A1 9/2010
CA 2755848 A1 4/2013

(Continued)

OTHER PUBLICATIONS

International Search Report issued by the Canadian Intellectual Property Office dated Feb. 16, 2015 in connection with International Patent Application No. PCT/CA2014/000855, 4 pages.

(Continued)

*Primary Examiner* — Kipp C Wallace

(57) ABSTRACT

A set of pressure activated tools that could be used in a well bore to allow for hydraulic fracturing completions are provided. Methods, apparatuses and assemblies are described herein for perforating (also known as hydraulically fracturing or stimulating) subterranean formations. In some embodiments, an insert is provided having a body for sealing engagement with a port in a tubular member. The insert body can include a fold-over ledge and a membrane having a first mode wherein the membrane prevents fluid passage through the body and a second mode wherein the membrane partially disengages from the body upon treatment fluid reaching a threshold pressure and folds over the fold-over ledge in a bottle-cap opening manner to contribute to the fracture of the formation by the pressurized treatment fluid exiting the port.

14 Claims, 4 Drawing Sheets

Related U.S. Application Data

(60) Provisional application No. 61/921,254, filed on Dec. 27, 2013.

(51) Int. Cl.
*E21B 34/06* (2006.01)
*E21B 43/14* (2006.01)

(58) Field of Classification Search
CPC ..... Y10T 137/1692; Y10T 137/1744; Y10T 137/1699
See application file for complete search history.

(56) References Cited

U.S. PATENT DOCUMENTS

| | | | | |
|---|---|---|---|---|
| 5,167,337 | A | 12/1992 | Short, III et al. | |
| 5,267,666 | A | 12/1993 | Hinrichs et al. | |
| 5,425,424 | A | 6/1995 | Reinhardt et al. | |
| 5,558,114 | A * | 9/1996 | Strelow | F16K 17/162 137/68.21 |
| 6,006,938 | A * | 12/1999 | Mozley | F16K 17/1606 137/68.19 |
| 7,017,767 | B2 * | 3/2006 | Eijkelenberg | B65D 90/36 137/68.19 |
| 2003/0121663 | A1 | 7/2003 | Weng et al. | |
| 2008/0178938 | A1 | 7/2008 | Stokes et al. | |
| 2011/0192613 | A1 | 8/2011 | Garcia et al. | |
| 2012/0111566 | A1 | 5/2012 | Sherman et al. | |
| 2014/0231064 | A1 | 8/2014 | Kent et al. | |
| 2015/0260012 | A1 * | 9/2015 | Themig | E21B 34/14 166/374 |

FOREIGN PATENT DOCUMENTS

| | | | |
|---|---|---|---|
| WO | 99/14520 | A1 | 3/1999 |
| WO | 2014/053062 | A1 | 4/2014 |

OTHER PUBLICATIONS

Written Opinion of the International Searching Authority issued by the Canadian Intellectual Property Office dated Feb. 16, 2015 in connection with International Patent Application No. PCT/CA2014/000855, 6 pages.

* cited by examiner

PRESSURE ACTIVATED COMPLETION TOOLS, BURST PLUGS, AND METHODS OF USE

CROSS REFERENCE TO RELATED APPLICATIONS

This application is a continuation application of U.S. patent application Ser. No. 15/108,227 filed on Jun. 24, 2016, which is a National Phase Entry of International PCT Patent Application Ser. No. PCT/CA2014/000855 filed on Dec. 1, 2014, which claims the benefit of U.S. Provisional Patent Application Ser. No. 61/921,254 filed on Dec. 27, 2013. The contents of the aforementioned applications are incorporated by reference herein.

FIELD

The present disclosure is related to the field of methods and apparatus of completion tools, in particular, methods and apparatus of pressure activated completion tools and burst plugs for hydraulic fracturing.

BACKGROUND

The technique of hydraulic fracturing (commonly referred to as "fracing" or "fracking") is used to increase or restore the rate at which fluids, such as oil, gas or water, can be produced from a reservoir or formation, including unconventional reservoirs such as shale rock or coal beds. Fracing is a process that results in the creation of fractures in rocks. The most important industrial use is in stimulating oil and gas wells where the fracturing is done from a wellbore drilled into reservoir rock formations to increase the rate and ultimate recovery of oil and natural gas.

Hydraulic fractures may be created or extended by internal fluid pressure which opens the fracture and causes it to extend through the rock. Fluid-driven fractures are formed at depth in a borehole and can extend into targeted formations. The fracture width is typically maintained after the injection by introducing a proppant into the injected fluid. The fracturing fluid has two major functions, to open and extend the fracture; and to transport the proppant along the length of the fracture.

Current fracing systems and methods, however, are expensive and inefficient.

In many cases, it is desired to target the fracturing fluid at a specific location in a formation. Prior attempts to address this issue include the devices and methods disclosed in Canadian Patent Application 2,755,848 and Canadian Patent 2,692,377, both of which are hereby incorporated by reference in their entirety.

Both of these documents disclose a burst opening for fracing fluid to exit the completion/service string and access the formation. Application 2,755,848 teaches a "projectile core" in the burst opening. In practice, it was discovered that the dislodged projectile can actually worsen the performance of the tool by blocking fluid flow outside of the tool.

Safer, more productive, and cost-effective fracing methods and systems are quickly becoming sought after technology by oil and natural gas companies. It is, therefore, desirable to provide an apparatus and method for hydraulic fracturing that overcomes the shortcomings of the prior art. Accordingly, there is a need to provide a safer, more productive, and more efficient fracing apparatus and method.

SUMMARY

A set of pressure activated tools that could be used in a well bore to allow for hydraulic fracturing completions are provided. Methods, apparatuses and assemblies are described herein for perforating (also known as hydraulically fracturing or stimulating) subterranean formations. In some embodiments, an insert is provided having a body for sealing engagement with a port in a tubular member. The insert body can include a fold-over ledge and a membrane having a first mode wherein the membrane prevents fluid passage through the body and a second mode wherein the membrane partially disengages from the body upon treatment fluid reaching a threshold pressure and folds over the fold-over ledge in a bottle-cap opening manner to contribute to the fracture of the formation by the pressurized treatment fluid exiting the port.

Broadly stated, in some embodiments, an assembly is provided for perforating a subterranean formation for use in a tubular member having at least one port, the tubular member being insertable in a wellbore intersecting the subterranean formation and adapted to receive a treatment fluid under pressure, the assembly comprising: an insert having a body for sealing engagement with the port, the body including a fold-over ledge and a membrane having a first mode wherein the membrane prevents fluid passage through the body and a second mode wherein the membrane partially disengages from the body upon the treatment fluid reaching a threshold pressure and folds over the fold-over ledge in a levered bottle-cap opening manner to contribute to the fracture of the formation by the pressurized treatment fluid exiting the port.

Broadly stated, in some embodiments, a downhole apparatus is provided for perforating a subterranean formation comprising: a tubular member insertable in a wellbore intersecting the subterranean formation for receiving a treatment fluid under pressure; at least one port in the tubular member; and, an insert sealingly engaged with the port, the insert including a body for sealing engagement with the port, the body including a fold-over ledge and a membrane having a first mode wherein the membrane prevents fluid passage through the body and a second mode wherein the membrane partially disengages from the body upon the treatment fluid reaching a threshold pressure and folds over the fold-over ledge in a levered bottle-cap opening manner to contribute to the fracture of the formation by the pressurized treatment fluid exiting the port.

Broadly stated, in some embodiments, a method is provided for hydraulic fracturing a formation in a well, the method comprising the steps of: providing an assembly or apparatus as described herein; supplying fracture fluid to the assembly or apparatus; partially disengaging the membrane from the body upon the fluid reaching a threshold pressure; allowing fracture fluid to flow past the membrane to contact the formation; and fracturing the formation in the well.

DETAILED DESCRIPTION OF EMBODIMENTS

An apparatus and method for perforating (also known as hydraulically fracturing or stimulating) subterranean formations are provided herein.

Figure 1:
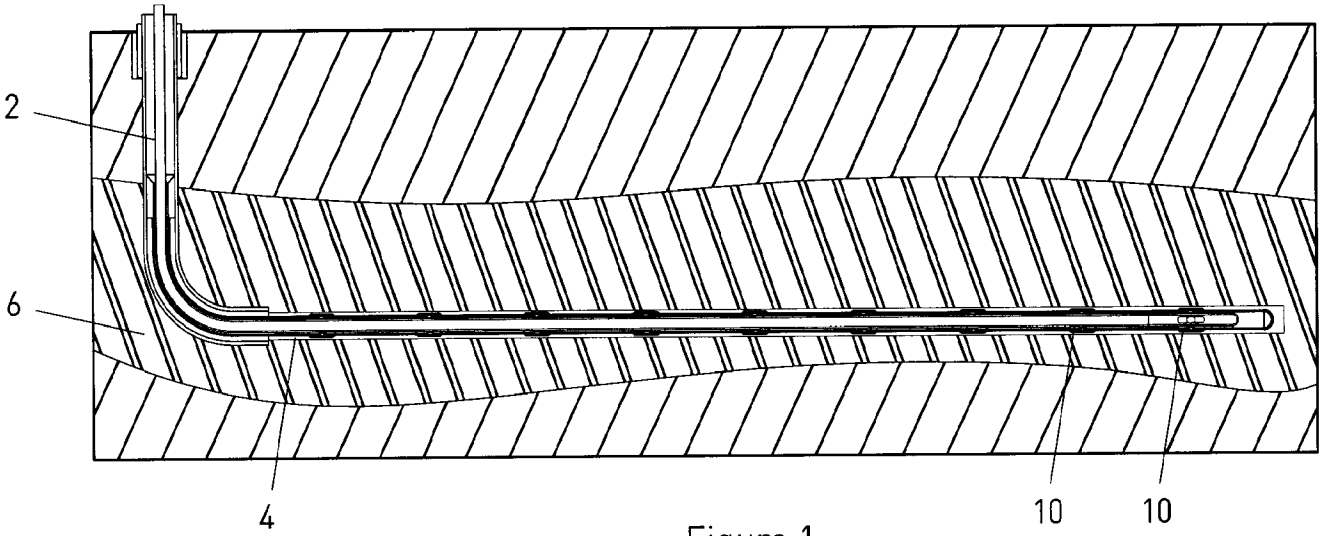
FIG. 1 is a diagram of a side elevation view of a well depicting an embodiment of an apparatus for hydraulic fracing where the formation and well head are visible.
Figure 2A:
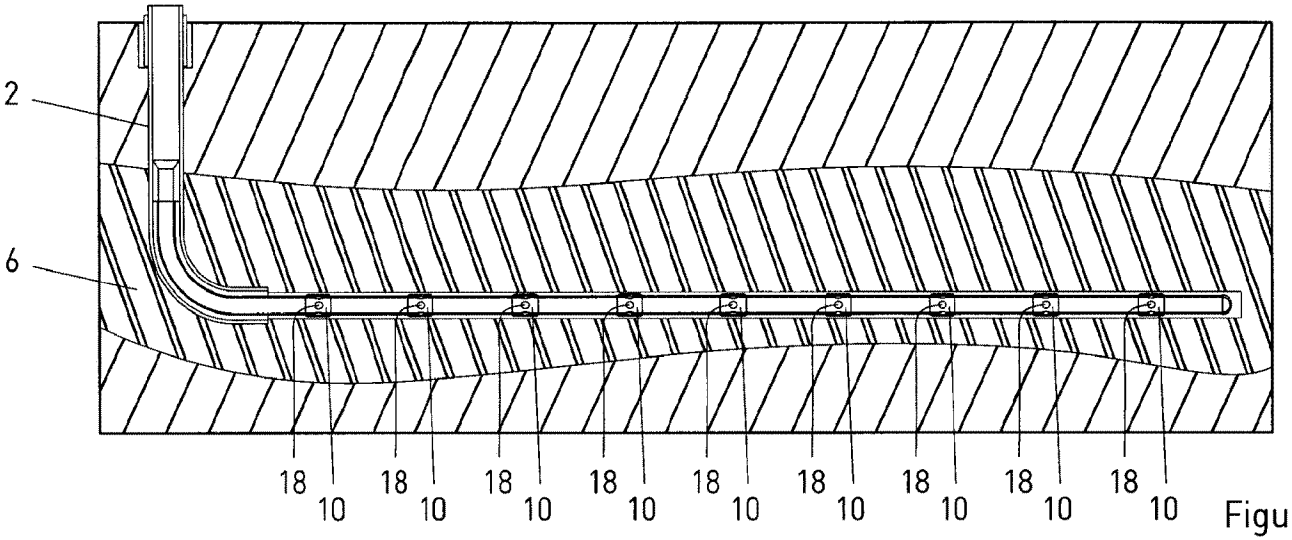
FIGS. 2A and 2B are diagrams of a side elevation view of a well depicting embodiments of an apparatus for hydraulic fracing along a completion string.
Figure 2B:
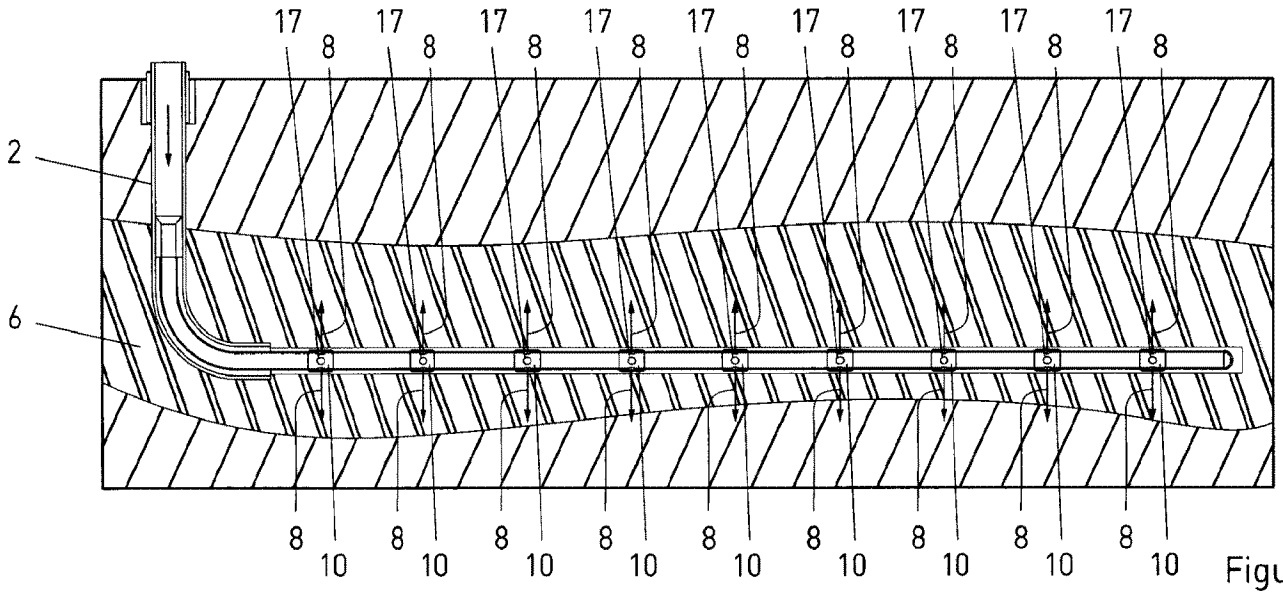

Referring to FIG. 1 and FIG. 2, a well 2 is shown from a side elevation view where service/completion string 4 is downhole and proximate formation 6. Fracing fluid 8 can be pumped downhole through service/completion string 4 to fracing apparatus 10. Apparatus 10 can then release pressurised fracing fluid 8 to fracture formation 6.

Figure 3B:
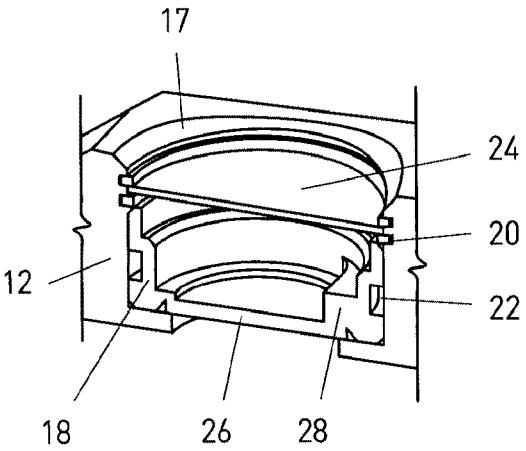
FIGS. 3B to 3D are perspective, close-up, cross-sectional views of an embodiment of a burst insert for use in an apparatus for hydraulic fracing.
Figure 3C:
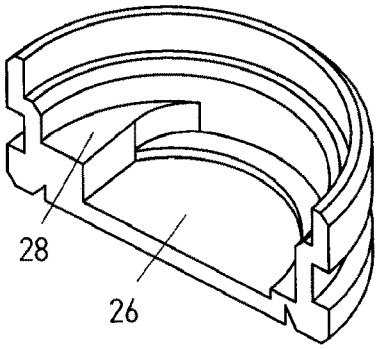
Figure 3A:
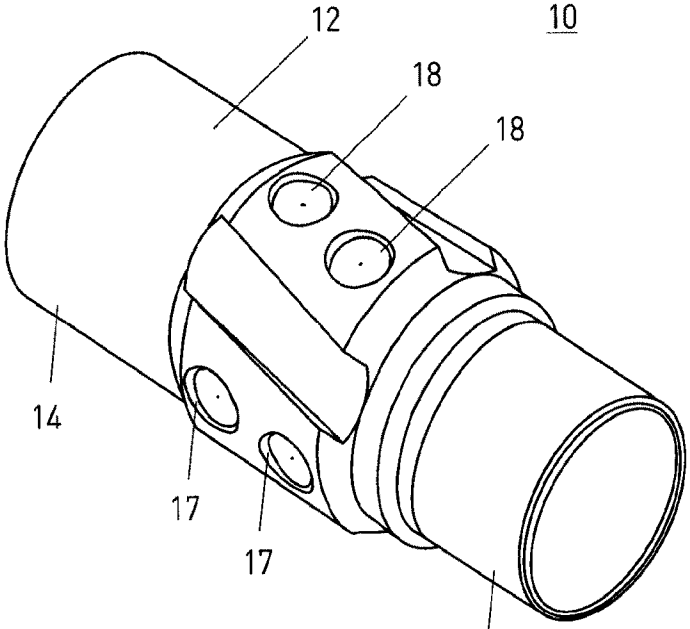
FIG. 3A is a perspective view of an embodiment of an apparatus for hydraulic fracing.
Figure 3E:
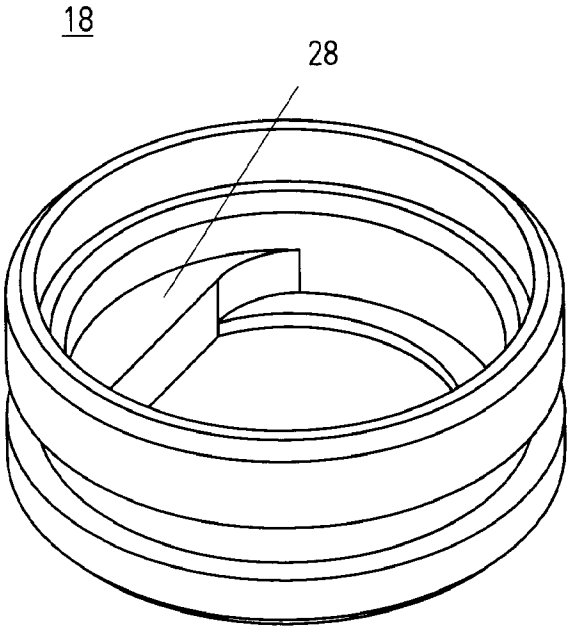
FIG. 3E is a perspective close-up view of an embodiment of a burst insert for use in an apparatus for hydraulic fracing.

Referring now to FIG. 3A, an embodiment of apparatus 10 is shown comprising a main body 12 with a top connector 14 and a bottom connector 16. Top and bottom as used herein are relative term and it would be understood by one skilled in the art that the orientation could be inverted without detracting from the function of apparatus. Similarly, top and bottom can be interchanged with terms such as left and right, or upstream and downstream, as required by the context of apparatus 10. Main body 12 can be tubular as to allow a fluid connection with a service/completion sting and allow fracing (or other) fluid to pass through body 12.

Main body 12 can include one or more burst ports 17 which can be filled with a burst plug 18. Referring now to FIG. 3B, in some embodiments, burst plug 18 can be positioned towards the interior of, and blocking the opening of burst port 17. Retention means, such as a burst plug retainer 20 and a seal 22 can be used to hold burst plug 18 in place.

In some embodiments, one or more ports 17 can be located in a radially outwardly extending fin portion of the tubular member body 12 where an annulus can be formed between the tubular member and the wellbore can be reduced adjacent the fin portion.

A debris barrier (or debris shield) 24 can also be used to cover burst port 17. In some embodiments, debris barrier 24 can be positioned towards the exterior of the opening of burst port 17. In some embodiments, a chamber can be defined between burst plug 18 and debris barrier 24. Debris barrier 24 can prevent debris and other substances from blocking burst port 17. In some cases, debris barrier 24 can block cement and other debris from entering burst port 17 or main body 12 and cementing the apparatus 10 shut. In some embodiments, debris barrier 24 can be vented to provide a means of equalizing pressure between the chamber and an annulus formed between the tubular member and the wellbore.

In some embodiments, the chamber can be filed with a substance (such as a gel) for resisting entry of a wellbore fluid (such as cement) thereinto through the hole or vent.

Figure 3D:
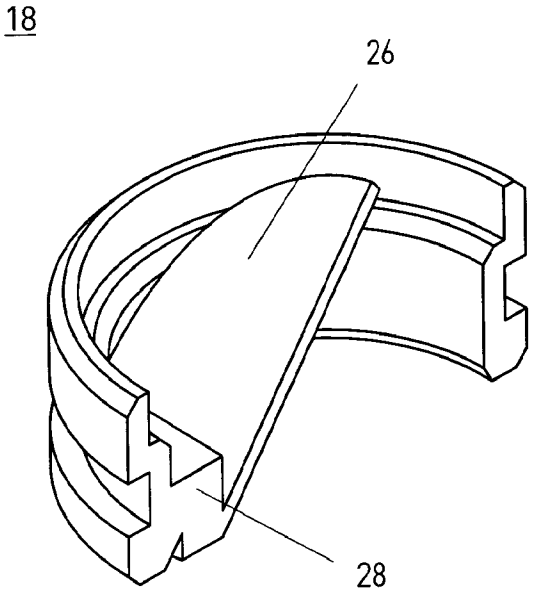

In some embodiments, burst plug 18 can be designed to include a burst plug membrane 26 and a fold-over ledge 28, where membrane 26 can be thinner than ledge 28. In some embodiments, the membrane can formed integrally with the burst plug insert body at one end thereof. When under pressure from the interior of main body 12, membrane 26 can tear away from burst plug 18 around a portion of the perimeter of membrane 26. The portion of membrane 26 attached to ledge 28 can have a stronger connection and can be retained. As membrane 26 bursts away from and out of burst port 17, the portion retained by ledge 28 can remain intact and cause membrane 26 to fold outwardly onto ledge 28. As such, burst plug 18 can open in a levered manner similar to a bottle cap, although a portion of membrane 26 remains connected to burst plug 18. Compare FIG. 3C with FIG. 3D where a first position, or mode, is shown in FIG. 3C as a non-burst position with membrane 26 intact within burst plug 18 thus preventing fluid from exiting main body 12. FIG. 3D shows a second position, or mode, wherein burst plug 18 is in a burst position with membrane 26 partially disengaged from burst plug 18 thus allowing fluid to exit main body 12. In these embodiments, burst plug 18 does not require an atmospheric chamber or a core that disengages.

In operation, a burst plug assembly 18 and/or apparatus 10 can be used in a method of hydraulic fracturing a formation in a well, wherein the assembly and/or apparatus is provided, fracture fluid is supplied, the membrane 26 is opened at a threshold pressure, fracture fluid flows past membrane 26 to contact the formation, and the formation in the well is fractured.

In determining a threshold pressure at which membrane 26 can be expected to partially disengage from the surrounding insert body, it will be appreciated that consideration must be given to such criteria as the membrane and insert material, the thickness of membrane 26 and the configuration of burst plug 18. For instance, in some embodiments, the burst plug 18 can be configured to disengage from insert body when the fluid pressure applied to the inner wall reaches or exceeds about 2000 psi, or at another desired pressure.

Although a few embodiments have been shown and described, it will be appreciated by those skilled in the art that various changes and modifications might be made without departing from the scope of the invention. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

While the above description details certain embodiments of the invention and describes certain embodiments, no matter how detailed the above appears in text, the invention can be practiced in many ways. Details of the apparatuses and methods may vary considerably in their implementation details, while still being encompassed by the invention disclosed herein. These and other changes can be made to the invention in light of the above description.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification. Accordingly, the actual scope of the invention encompasses not only the disclosed embodiments, but also all equivalent ways of practicing or implementing the invention.

The above description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. The elements and acts of the various embodiments described above can be combined to provide further embodiments.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

We claim:

1. An assembly for perforating a subterranean formation for use in a tubular member having at least one port, the tubular member being insertable in a wellbore intersecting the subterranean formation and adapted to receive a treatment fluid under pressure, the assembly comprising:

an insert having a body for sealing engagement with the port, the body including a planar fold-over ledge and a planar membrane having a first mode wherein the planar membrane is sealingly engaged with the body along an outer perimeter of the planar membrane and prevents fluid from exiting the body and a second mode wherein the planar membrane partially disengages from the body along the outer perimeter of the planar membrane and remains as a unitary piece upon the treatment fluid reaching a threshold pressure and folds over the fold-over ledge in a levered bottle-cap opening manner to contribute to the fracture of the formation by the pressurized treatment fluid exiting the port.

2. The assembly of claim 1 further comprising a debris shield for mounting in the port spaced from the body wherein the shield and insert define a chamber therewithin.

3. The assembly of claim 2 wherein the shield includes a means of equalizing pressure between the chamber and an annulus formed between the tubular member and the wellbore.

4. The assembly of claim 3 wherein the equalizing means comprises at least one hole in the shield.

5. The assembly of claim 4 wherein the chamber includes a substance for resisting entry of a wellbore fluid thereinto through the hole.

6. The assembly of claim 5 wherein the wellbore fluid comprises cement and the substance comprises a gel adapted to prevent the cement from setting.

7. A downhole apparatus for perforating a subterranean formation comprising:

a tubular member insertable in a wellbore intersecting the subterranean formation for receiving a treatment fluid under pressure;

at least one port in the tubular member; and, an insert sealingly engaged with the port, the insert including a body for sealing engagement with the port, the body including a planar fold-over ledge and a planar membrane having a first mode wherein the planar membrane is sealingly engaged with the body along an outer perimeter of the planar membrane and prevents fluid passage through the body and a second mode wherein the planar membrane partially disengages from the body along the outer perimeter of the planar membrane and remains as a unitary piece upon the treatment fluid reaching a threshold pressure and folds over the fold-over ledge in a levered bottle-cap opening manner to contribute to the fracture of the formation by the pressurized treatment fluid exiting the port.

8. The apparatus of claim 7 further comprising a debris shield spaced from the body wherein the shield and insert define a chamber therewithin.

9. The apparatus of claim 8 wherein the shield is perforated to provide a means of equalizing pressure between the chamber and an annulus formed between the tubular member and the wellbore.

10. The apparatus of claim 9 wherein the chamber includes a substance for resisting entry of a wellbore fluid thereinto through the hole.

11. The apparatus of claim 10 wherein at least some of the substance is adapted to exit the hole and prevent the wellbore fluid from setting in the port.

12. The apparatus of claim 11 wherein the port is located in a radially outwardly extending fin portion of the tubular member where an annulus formed between the tubular member and the wellbore is reduced adjacent the fin portion.

13. A method of hydraulic fracturing a formation in a well, the method comprising the steps of:

supplying fracture fluid to the assembly of claim 1 in a tubular member having at least one port wherein tubular member is inserted in a wellbore intersecting the formation;

partially disengaging the planar membrane from the body upon the fluid reaching a threshold pressure;

allowing fracture fluid to flow past the planar membrane to contact the formation; and fracturing the formation in the well.

14. A method of hydraulic fracturing a formation in a well, the method comprising the steps of:

supplying fracture fluid to the apparatus of claim 8;

partially disengaging the planar membrane from the body upon the fluid reaching a threshold pressure;

allowing fracture fluid to flow past the planar membrane to contact the formation; and fracturing the formation in the well.

* * * * *